US007874400B2

(12) United States Patent
Teisseyre

(10) Patent No.: US 7,874,400 B2
(45) Date of Patent: Jan. 25, 2011

(54) NOISE ISOLATION DEVICE FOR SWIMMING POOL PUMPS AND OTHER MACHINERY

(75) Inventor: Laurent G. Teisseyre, San Marcos, CA (US)

(73) Assignee: Premier Innovations, Inc., San Diego, CA (US)

( * ) Notice: Subject to any disclaimer, the term of this patent is extended or adjusted under 35 U.S.C. 154(b) by 131 days.

(21) Appl. No.: 11/856,496

(22) Filed: Sep. 17, 2007

(65) Prior Publication Data

US 2009/0071746 A1 Mar. 19, 2009

(51) Int. Cl.
*G10K 11/00* (2006.01)

(52) U.S. Cl. ..... 181/200; 181/205

(58) Field of Classification Search ..... 181/198, 181/200, 202, 204, 205; 417/312
See application file for complete search history.

(56) References Cited

U.S. PATENT DOCUMENTS 3,296,997 A * 1/1967 Hoiby et al. ..... 440/88 R
3,612,213 A * 10/1971 Piko ..... 181/200
3,789,954 A * 2/1974 Raleigh ..... 181/205
3,881,569 A * 5/1975 Evans, Jr. ..... 181/200
3,951,228 A * 4/1976 Schnell ..... 181/200
3,963,094 A * 6/1976 Nowikas ..... 181/198
4,120,376 A * 10/1978 Palmer ..... 181/204
4,220,880 A 9/1980 Woodard
4,314,602 A * 2/1982 Frederick et al. ..... 165/10
4,359,085 A * 11/1982 Mueller ..... 165/47
4,608,946 A 9/1986 Tanaka et al.
4,702,201 A 10/1987 Odo et al.
4,733,750 A * 3/1988 Poirier et al. ..... 181/202
4,892,464 A * 1/1990 Schydlo ..... 417/201
4,982,812 A * 1/1991 Hwang ..... 181/202
5,151,018 A * 9/1992 Clendenin et al. ..... 417/312
5,272,285 A * 12/1993 Miller ..... 181/202
5,297,517 A * 3/1994 Brandt et al. ..... 123/198 F
5,929,394 A * 7/1999 Westerbeke, Jr. ..... 181/204
6,722,466 B1 * 4/2004 Tong et al. ..... 181/200
6,750,573 B1 6/2004 Schmidt et al.
6,810,989 B1 * 11/2004 Dantlgraber et al. ..... 181/202
2002/0029529 A1 3/2002 Waalkes
2002/0158524 A1 10/2002 Bobay et al.
2005/0060951 A1 3/2005 Kalnay
2006/0021823 A1 2/2006 Kohara et al.

OTHER PUBLICATIONS

Brown, Athol, "Swimming-pool Filter-motor Noise Pollution: Domestic Noise Pollution—An Australian Experience", Noise Pollution Clearinghouse, May 1999, Vermont, U.S.A.
"Visual & Acoustic Privacy Advisory Information", City of Nedlands, Nedlands WA.
"Part 18—Swimming Pool & Spa Equipment", Queensland Development Code, Apr. 30, 2003.
"Netwell Noise Control", http://www.controlnoise.com/qbs1blanket.html.
"Environmental Noise Control—The Noise Control Specialists", http://www.environmental-noise-control.com/industrial.html.

* cited by examiner

*Primary Examiner*—Elvin G Enad
*Assistant Examiner*—Jeremy Luks
(74) *Attorney, Agent, or Firm*—Charles F. Reidelbach, Jr.

(57) ABSTRACT

A noise isolation device includes a plurality of panels comprising a sound absorbent material for assembling into an enclosure for a pump mechanism and a plurality of fasteners built into the panels for assembling the panels to form an enclosure for a pump mechanism and for disassembling the panels to remove the enclosure from the pump mechanism.

10 Claims, 4 Drawing Sheets

NOISE ISOLATION DEVICE FOR SWIMMING POOL PUMPS AND OTHER MACHINERY

BACKGROUND OF THE INVENTION

1. Field of the Invention

The present invention is directed to devices for isolating machinery noise. More specifically, but without limitation thereto, the present invention is directed to devices for isolating noise generated by outdoor machinery such as swimming pool pumps.

2. Description of Related Art

Many residences and commercial establishments have outdoor swimming pools equipped with electric pumps for circulating water through a filter. A widely recognized problem associated with swimming pool pump machinery is the continuous noise transmitted through the air while the pump is operating that may disturb neighbors as well as swimming pool users. Regulations have been imposed in several communities to limit noise disturbance from outdoor swimming pool machinery; however, there has been a lack of progress in the development of economical and effective devices that can satisfactorily isolate the noise at the source.

SUMMARY OF THE INVENTION

In one embodiment, a noise isolation device includes a plurality of panels comprising a sound absorbent material and a plurality of fasteners built into the panels for assembling the panels to form an enclosure for a pump mechanism and for disassembling the panels to remove the enclosure from the pump mechanism.

In another embodiment, a noise isolation device includes a plurality of panels, each panel comprising a layer of a sound absorbent material between an outer layer and an inner layer of a weatherproof material. A plurality of fasteners is built into the panels for assembling the panels to form an enclosure around a pump mechanism and for disassembling the panels to remove the enclosure from the pump mechanism. An opening is formed in one of the panels to fit around a pump motor coupled to the pump mechanism to exclude the pump motor from the enclosure.

In a further embodiment, a noise isolation device includes a plurality of panels comprising a sound absorbent material for assembling into an enclosure for a pump mechanism. The panels include a layer of sound absorbent material between layers of a waterproof material, and the panels constitute a set of prefabricated panels made to fit a pump mechanism for a plurality of pump assemblies. A plurality of fasteners is built into the panels for assembling the panels to form an enclosure around the pump mechanism and for disassembling the panels to remove the enclosure from the pump mechanism. An opening is formed in one of the panels to fit around a pump motor coupled to the pump mechanism to exclude the pump motor from the enclosure. An opening is formed in one of the panels for fitting the panel around an endless portion of a water supply line. An opening is formed in one of the panels for fitting the panel around an endless portion of a power supply line. A closable opening is formed in one of the panels for providing access to a pump filter basket.

BRIEF DESCRIPTION OF THE DRAWINGS

The above and other aspects, features and advantages will become more apparent from the description in conjunction with the following drawings presented by way of example and not limitation, wherein like references indicate similar elements throughout the several views of the drawings, and wherein.

Elements in the figures are illustrated for simplicity and clarity and have not necessarily been drawn to scale. For example, the dimensions, sizing, and/or relative placement of some of the elements in the figures may be exaggerated relative to other elements to clarify distinctive features of the illustrated embodiments. Also, common but well-understood elements that may be useful or necessary in a commercially feasible embodiment are often not depicted in order to facilitate a less obstructed view of the illustrated embodiments.

DESCRIPTION OF THE ILLUSTRATED EMBODIMENTS

The following description is not to be taken in a limiting sense, rather for the purpose of describing by specific examples the general principles that are incorporated into the illustrated embodiments. For example, certain actions or steps may be described or depicted in a specific order to be performed. However, practitioners of the art will understand that the specific order is only given by way of example and that the specific order does not exclude performing the described steps in another order to achieve substantially the same result. Also, the terms and expressions used in the description have the ordinary meanings accorded to such terms and expressions in the corresponding respective areas of inquiry and study except where other meanings have been specifically set forth herein.

Swimming pools are commonly found, for example, in backyards of residences, in commercial establishments such as hotels and fitness centers, and in public facilities such as recreation centers. Typically, water is circulated in a swimming pool through a filter by a pump mechanism driven by an electric motor.

Figure 1:
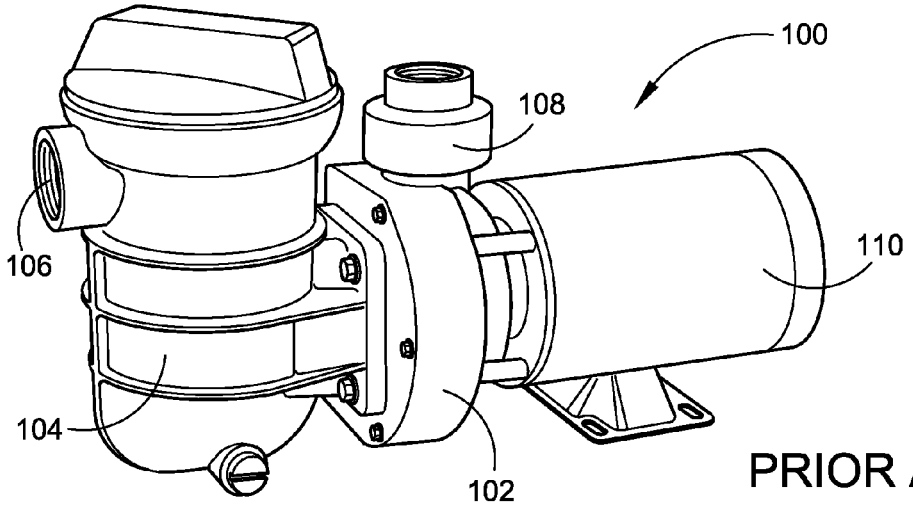
PRIOR ART FIG. 1
FIG. 1 illustrates a side view of a pump assembly of the prior art.

FIG. 1 illustrates a side view of a pump assembly 100 of the prior art. Shown in FIG. 100 are a pump mechanism 102, a pump filter 104, a water intake 106, a water outlet 108, and a pump motor 110.

In FIG. 1, the pump mechanism 102 typically includes an impeller that moves water from the water intake 106 to the water outlet 108 under a pressure determined by the speed of pump motor 110 that drives the impeller in the pump mechanism 102. The pump filter 104 traps objects that may be drawn into the water intake 106 to prevent damage to the pump mechanism 102. The motion of the impeller in the water causes cavitation, that is, the formation of air bubbles on the surfaces of the impeller blades. The cavitation produces a high-pitched sound that is generally the dominant noise source in the pump assembly 100. In contrast to the pump mechanism 102, the pump motor 110 does not usually generate a significant amount of noise.

Manufacturers of swimming pool pumps have added structures around the pump mechanism to absorb the cavitation noise; however, an enclosure having a higher degree of noise isolation is desirable for meeting regulated noise limits and for avoiding creating a disturbance to neighbors and users of swimming pools. Disadvantageously, previous enclosures for isolating noise from pool pumps typically cover the motor, which may result in inadequate ventilation and excessive heat buildup that may damage the pump assembly 100. Also, the construction of previous enclosures generally includes permanent fasteners, for example, nails and adhesives. Permanent fasteners generally require a time-consuming and costly installation to set up the enclosure and may also require a correspondingly inconvenient demolition of the enclosure when the pump assembly 100 is removed or replaced.

In one embodiment, a noise isolation device includes a plurality of panels comprising a sound absorbent material and a plurality of fasteners built into the panels for assembling the panels to form an enclosure for a pump mechanism and for disassembling the panels to remove the enclosure from the pump mechanism.

Figure 2:
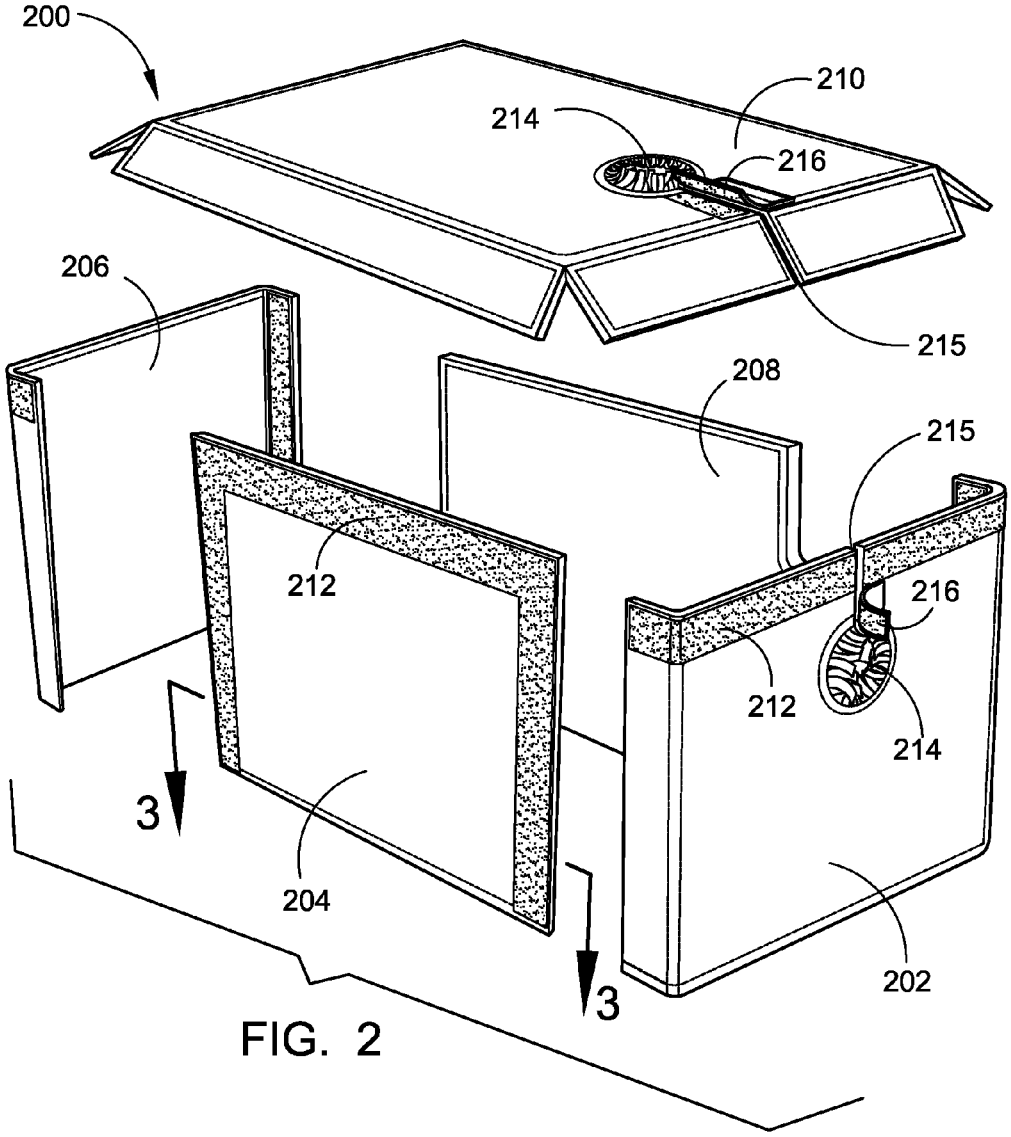
FIG. 2 illustrates a perspective view of an enclosure for isolating noise from a pump mechanism.

FIG. 2 illustrates a perspective view of an enclosure 200 for isolating noise from a pump mechanism. Shown in FIG. 2 are panels 202, 204, 206, 208, and 210, fasteners 212, openings 214, slots 215, and flaps 216.

In FIG. 2, each of the panels 202, 204, 206, 208, and 210 has the fasteners 212 built into the panel sides for assembling the panels 202, 204, 206, 208, and 210 to form the enclosure 200. The fasteners 212 may be, for example, Velcro or another type of reclosable fastener built into the panels 202, 204, 206, 208, and 210, for example, by stitching the Velcro to the panels 202, 204, 206, 208, and 210 or by attaching the Velcro to the panels 202, 204, 206, 208, and 210 by an adhesive. The fasteners 212 may also be used for disassembling the panels 202, 204, 206, 208, and 210 to remove the enclosure 200 from the pump assembly 100 as illustrated in FIG. 2 by the top panel 210, which has been disassembled from the side panels 202, 204, 206, and 208. In the example of FIG. 2, the reclosable fasteners 212 enable the assembly and disassembly of the panels 202, 204, 206, 208, and 210 to be conveniently performed manually without tools. This feature allows the enclosure 200 to be installed economically and quickly by the user, in contrast to permanent installations that may require skilled masonry and carpentry. The enclosure 200 may also be disassembled and removed from the pump assembly with equal convenience, for example, to service or to replace the pump assembly.

The panels 202, 204, 206, 208, and 210 may be custom made to fit a specific pump mechanism, or they may be selected from a set of prefabricated panels made to fit each of a plurality of pump mechanisms having different dimensions. The openings 214 are shaped to provide a close fit for one or more of the panels 202, 204, 206, 208, and 210 around water supply lines that connect to the water intake 106 and the water outlet 108 of the pump assembly 100. The openings 214 include the slots 215 that extend to a panel edge so that the panels 202, 204, 206, 208, and 210 fit around the water supply lines without having to disconnect the water supply lines from the pump assembly 100, that is, the panels 202, 204, 206, 208, and 210 may be fitted around a portion of the water supply lines that does not include an end. An opening 214 may also be included to fit closely around a power supply line or other type of connection to the pump assembly (not shown). In the illustrated embodiment, the slots 215 from the openings 214 to the edge of the panel are closed by the flaps 216 that overlap the sides of the panel at the slots 215 and fastened, for example, with Velcro. In another embodiment, a hole is punched in one or more of the panels 202, 204, 206, 208, and 210 for routing a wire, and the hole is reinforced by a grommet to block the propagation of noise. In a further embodiment, a slot 215 is formed one or more of the panels 202, 204, 206, 208, and 210 to fit over a power wire in the same manner as the openings 214. A flap 216 may be added to cover the slot 215 and to secure the power wire according to well-known techniques.

When the panels 202, 204, 206, 208, and 210 are assembled around a pump assembly, the enclosure 200 becomes a self-supporting structure that is secured in place by the water supply lines and the pump assembly 100. The close fit between the panels 202, 204, 206, 208, and 210 and the water supply lines block noise from propagating through the enclosure 200 at the openings 214. The panels 202, 204, 206, 208, and 210 are conveniently assembled by the fasteners 212 to provide protection for the pump assembly 100 from sun and weather as well as to provide noise isolation.

Figure 3:
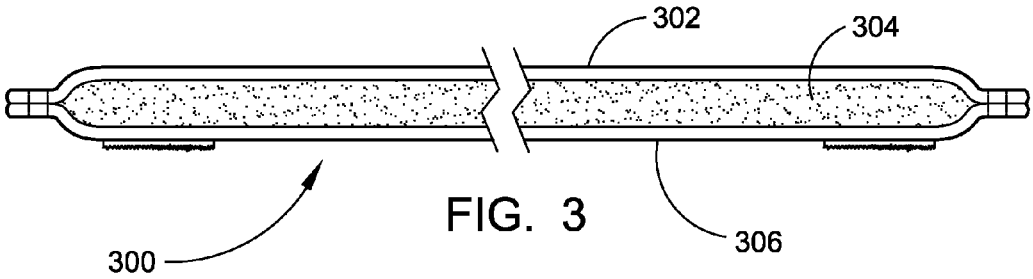
FIG. 3 shows a cross-sectional view of one of the panels in FIG. 2.

FIG. 3 shows a cross-sectional view 300 of the construction of the panels 202, 204, 206, 208, and 210 in FIG. 2. Shown in FIG. 3 are an outer layer 302, a sound absorbent layer 304, and an inner layer 306. The outer layer 302 is preferably made of a waterproof fabric or sheet material, for example, vinyl impregnated sailcloth or a waterproof vinyl. The outer layer 302 may be colored and patterned as desired, for example, to blend the enclosure 200 with plants and other landscaping features.

The sound absorbent layer 304 is preferably made of a commercially available sound absorbent material, for example, neoprene foam or fiberglass insulation. In other embodiments, the sound absorbent layer 304 may include multiple layers of sound absorbent materials. In further embodiments, the sound absorbent layer 304 may also include combinations of different and identical sound absorbent materials to suit specific applications. The inner layer 306 may be made, for example, of the same material as the outer layer 302. The sound absorbent layer 304 is preferably completely enclosed by the inner layer 306 and the outer layer 302 to protect the sound absorbent layer 304 from sun and weather. The outer layer 302 and the inner layer 306 may be fastened at the edges according to well-known techniques, for example, by stitching or by an adhesive. The outer layer 302 and the inner layer 306 advantageously protect the pump assembly 100 from sun and weather, while the sound absorbent layer 304 provides a reduction in noise level outside the enclosure of, for example, 75 percent or more. Using two layers of a sound absorbent material, noise levels taken 25 cm from the pump mechanism 102 measured 71-72 dB without the enclosure 200 and 64-65 dB with the enclosure 200, resulting in an economical noise reduction of 75 percent. Noise reduction is proportional to the square of the distance, consequently the longer the distance is from the source the better is the noise reduction. For example, at 7-10 m the noise typically will be not noticeable.

Figure 4:
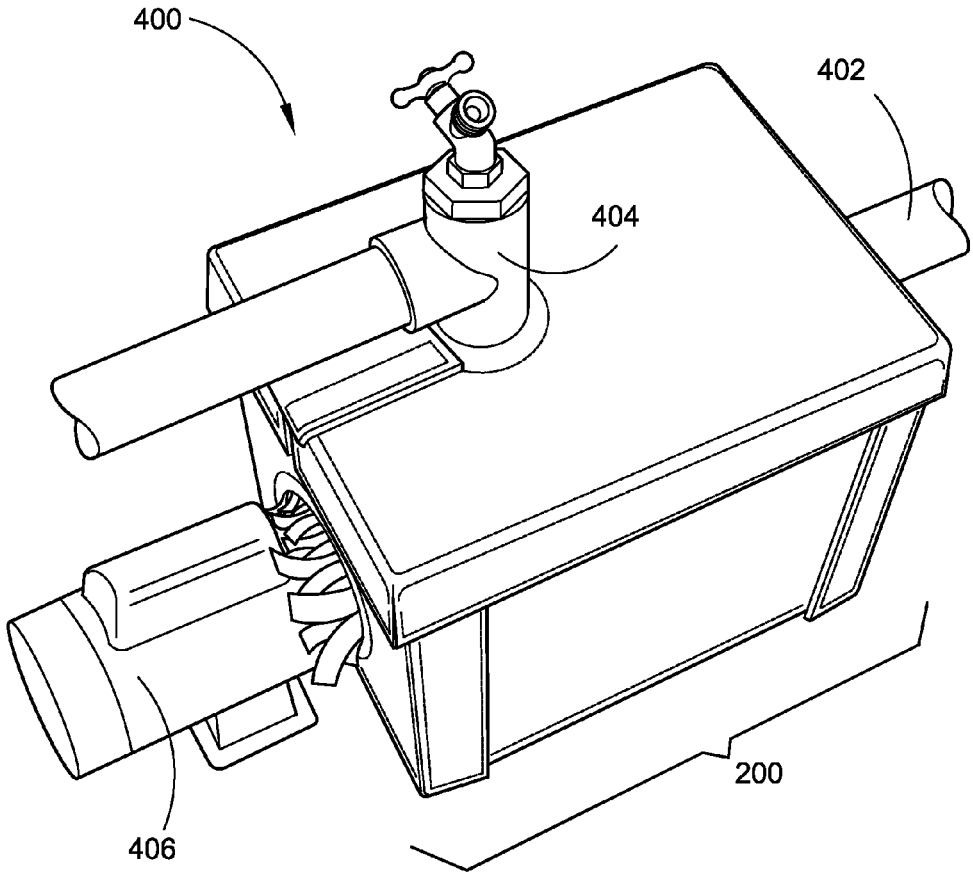
FIG. 4 illustrates a perspective view of the enclosure of FIG. 2 installed around a pump assembly.

FIG. 4 illustrates a perspective view 400 of the enclosure of FIG. 2 installed around a pump assembly. Shown in FIG. 4 are an enclosure 200, water supply lines 402 and 404, and a pump motor 406.

In FIG. 4, the panels 202, 204, 206, 208, and 210 of FIG. 2 have been assembled around a pump assembly while excluding the pump motor 406. Because the pump motor 406 typically does not produce a significant amount of noise, the pump motor 406 is advantageously excluded from the enclosure 200 to avoid overheating inside the enclosure 200 from the pump motor 406 and to provide ambient air cooling for the pump motor 406. Conversely, heat dissipation is limited inside the enclosure 200, which may help to prevent water inside the pump mechanism 102 from freezing. The enclosure 200 is secured in position by contact between the panels 202, 204, 206, 208, and 210 of the enclosure 200 and the water supply lines 402 and 404.

Figure 5:
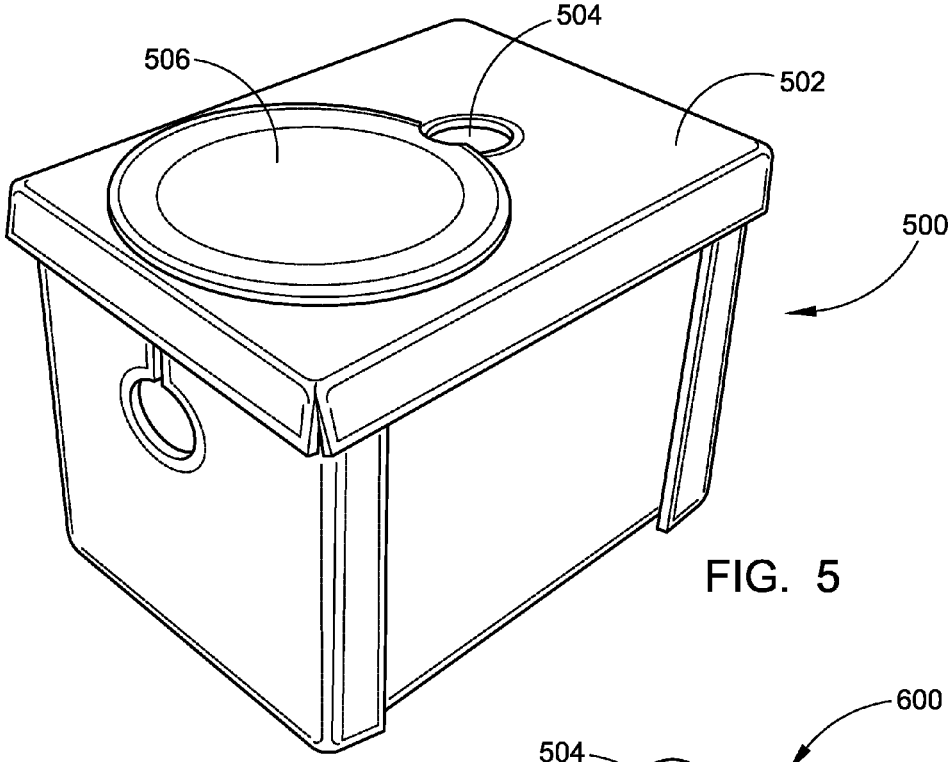
FIG. 5 illustrates a perspective view of an enclosure for isolating noise from a pump mechanism with a reclosable opening for providing access to a pump filter basket.

FIG. 5 illustrates a perspective view of an enclosure 500 for reducing noise from a pump mechanism with a reclosable opening for providing access to a pump filter basket. Shown in FIG. 5 are a top panel 502, an opening 504, and an access cover 506.

In FIG. 5, the access cover 506 isolates noise within the enclosure 500. The access opening 504 fits around a water supply line when the enclosure 500 is assembled around a pump assembly.

Figure 6:
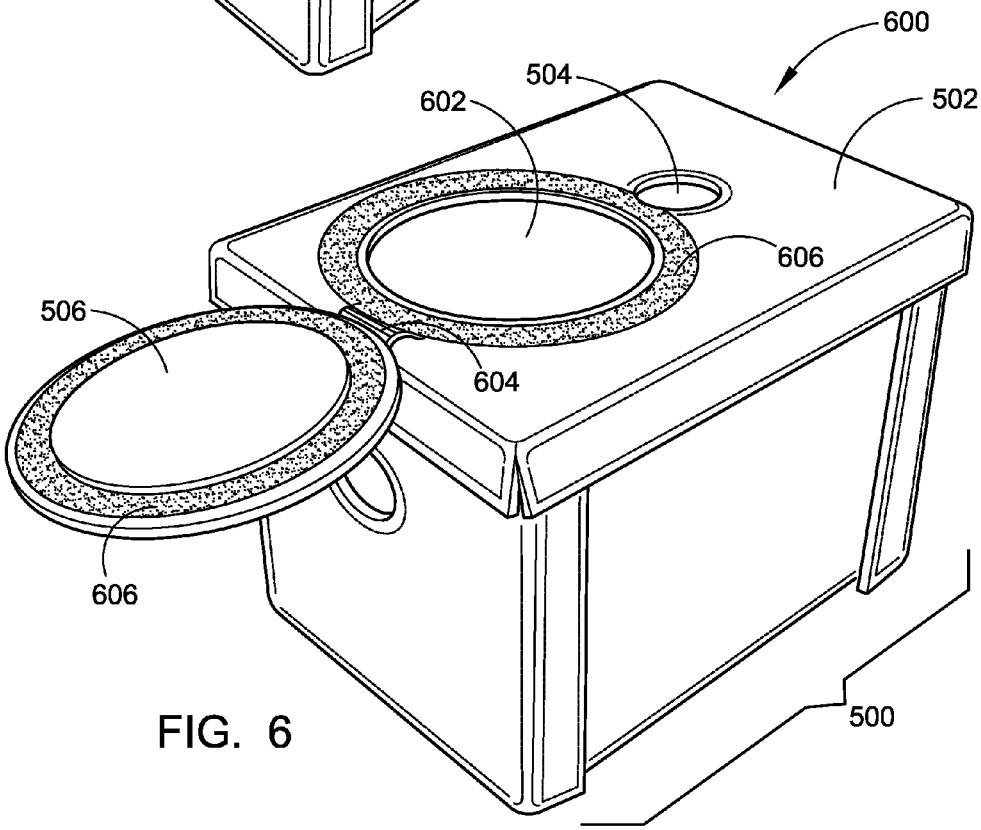
FIG. 6 illustrates a perspective view of the enclosure of FIG. 5 with the pump filter access cover removed.

FIG. 6 illustrates a perspective view 600 of the enclosure of FIG. 5 with the access cover removed. Shown in FIG. 6 are an enclosure 500, a top panel 502, an opening 504, an access cover 506, an access opening 602, a hinge 604, and a reclosable fastener 606. In this embodiment, the access cover 506 is hinged at 604 by stitching a portion of the circumference of the access cover 506 to the top panel 502. The access cover 506 is secured to the top panel 502 by the reclosable fastener 606, which may be, for example, a hook-and-loop fastener such as Velcro. The access cover 506 may be removed from the access opening 602 to provide convenient access to the pump filter 104 in FIG. 1 and closed afterward to restore the noise isolation provided by the enclosure 500.

Figure 7:
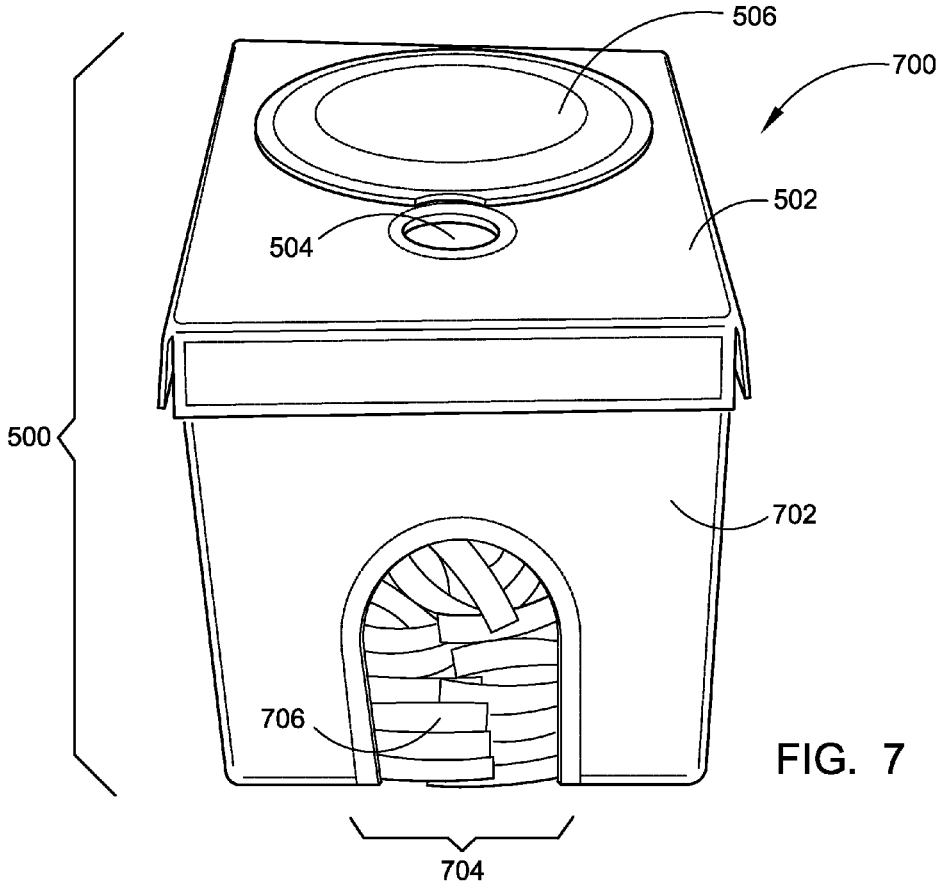
FIG. 7 illustrates a perspective view of the enclosure of FIG. 2 including an end panel for excluding the pump motor from the enclosure.

FIG. 7 illustrates a perspective view 700 of the enclosure 500 of FIG. 5 including an opening for excluding the pump motor from the enclosure. Shown in FIG. 7 are an enclosure 500, a top panel 502, an end panel 702, a pump motor opening 704, and flap seals 706.

In FIG. 7, the pump motor opening 704 fits around a pump assembly to exclude the pump motor from the enclosure 500 as described above with reference to FIG. 4. In this embodiment, the pump motor opening 704 extends to the edge of the end panel 702 so that the enclosure 500 may be assembled around the pump assembly 100 in FIG. 1 while the pump motor 110 is attached to the pump mechanism 102. The flap seals 706 may be, for example, strips made of the same material used for the outer layer of the panels described above with reference to FIG. 3. The flap seals 706 seal gaps between the pump motor and the pump motor opening 704 to block noise from propagating through the gaps. Identical flap seals may also be used to seal the openings around the water supply lines 402 and 404 in FIG. 4.

Figure 8:
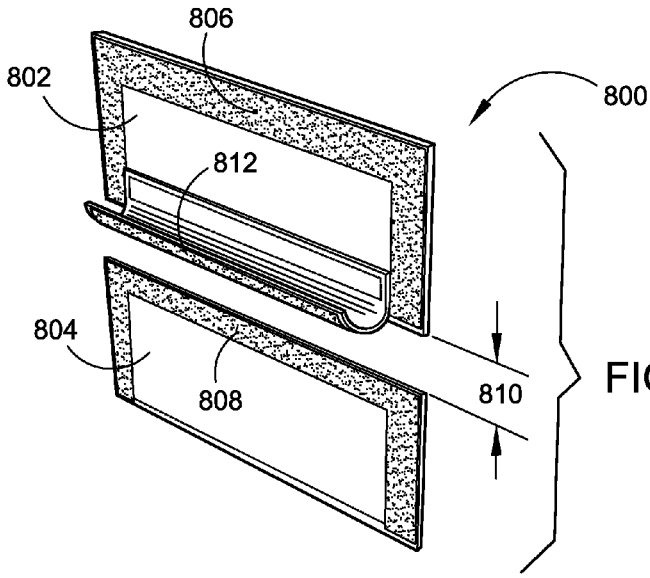
FIG. 8 illustrates a perspective view of a split side panel for the enclosure of FIG. 2 for fitting around wires and conduits.

FIG. 8 illustrates a perspective view 800 of a split side panel for the enclosure of FIG. 2 for fitting around wires and conduits. Shown in FIG. 8 are an upper panel 802, a lower panel 804, an upper panel fastener 806, a lower panel fastener 808, a panel spacing 810, and a panel flap 812.

In FIG. 8, one or both of the panels 204, 208 in FIG. 2 may be replaced by a split panel shown in FIG. 8 as the upper panel 802 and the lower panel 804. The upper panel 802 includes the upper panel fastener 806 for attaching the upper panel to the top panel 210 and to the end panels 202, 206 in the same manner described above with reference to FIG. 2. The lower panel 804 includes the lower panel fastener 808 for attaching the lower panel 804 to the end panels 202, 206 and for closing the panel spacing 810 by the panel flap 812. This configuration allows the enclosure to fit around wires, conduits, or other connection lines to the pump motor by placing the lower panel 804 under the connection lines. The panel spacing 810 is selected to accommodate the height or diameter of the connection lines. The upper panel 802 is placed over the connection lines, and the panel spacing 810 is closed by pressing the panel flap 812 over the connection lines and onto the lower panel fastener 808.

The embodiments of the noise isolation enclosure described above provide an economical and convenient alternative to the bulkier, expensive, and unattractive enclosures devised previously to combat the problem of noise pollution from swimming pool pumps. The noise isolation enclosure described above may also be employed to solve noise pollution problems caused by other machinery. Advantages of the noise isolation enclosure described above include economy of manufacture for different sizes and models of pump assemblies, fast assembly and disassembly without tools or special skills, effective noise reduction outside the enclosure, exposure of the pump motor to the air outside the enclosure to provide adequate ventilation for the pump assembly, and protection for the pump assembly from weather corrosion and sun deterioration.

The specific embodiments and applications thereof described above are for illustrative purposes only and do not preclude modifications and variations that may be made within the scope of the following claims.

What is claimed is:

1. A noise isolation device comprising:

a plurality of panels comprising a sound absorbent material, the panels shaped to form an enclosure around a pump mechanism and to exclude from the enclosure a portion of a pump motor attached to the pump mechanism; and a pump motor opening formed in one of the panels to fit around the pump motor when the panels are assembled around the pump mechanism while the pump motor is attached to the pump mechanism and a plurality of flap seals that seal gaps between the pump motor and the pump motor opening to block noise from propagating through the gaps.

2. The noise isolation device of claim 1 further comprising an opening formed in one of the panels shaped to fit the panel around an endless portion of a water supply line.

3. The noise isolation device of claim 1 further comprising an opening formed in one of the panels shaped to fit the panel around an endless portion of a power supply line.

4. The noise isolation device of claim 1, the panels comprising at least one layer of sound absorbent material between two layers of a waterproof material.

5. The noise isolation device of claim 1 further comprising a closable opening formed in one of the panels shaped to provide access through the panel to a pump filter.

6. The noise isolation device of claim 1, the panels being selected from a set of prefabricated panels shaped to fit each of a plurality of pump mechanisms having different dimensions.

7. The noise isolation device of claim 1 further comprising a hole formed in one of the panels reinforced by a grommet that fits around a power wire.

8. The noise isolation device of claim 1, the panels constituting a set of prefabricated panels shaped to fit each of a plurality of pump mechanisms having different dimensions.

9. The noise isolation device of claim 1, the flap seals comprising strips of a waterproof fabric or sheet material.

10. The noise isolation device of claim 1, the pump motor opening extending to an edge of the panel in which the pump motor opening is formed.

* * * * *